United States Patent [19]

Kinjo

[11] 3,996,547

[45] Dec. 7, 1976

[54] MOTOR PROTECTOR APPARATUS

[75] Inventor: Yoshimitsu Kinjo, Hatogaya, Japan

[73] Assignee: Texas Instruments Incorporated, Dallas, Tex.

[22] Filed: Sept. 5, 1974

[21] Appl. No.: 503,222

[52] U.S. Cl. ..... 337/363; 200/243; 337/89; 337/347

[51] Int. Cl.[2] ..... H01H 37/52; H01H 37/28

[58] Field of Search ..... 337/86, 85, 89, 38, 337/41, 42, 336, 362, 363, 347, 337; 200/243, 5 A, 83 N, 159 B

[56] References Cited

UNITED STATES PATENTS

| | | | |
|---|---|---|---|
| 2,406,719 | 8/1946 | Upson | 200/83 N |
| 2,721,913 | 10/1955 | Kent, Jr. | 200/83 N |
| 2,753,421 | 7/1956 | Mertler | 337/347 |
| 2,769,048 | 10/1956 | Harrold | 337/362 |
| 2,811,611 | 10/1957 | Odenwald | 337/362 |
| 2,996,590 | 8/1961 | Shockroo et al. | 337/86 |
| 3,452,313 | 6/1969 | Perry | 337/86 |
| 3,470,513 | 9/1969 | Shockroo et al. | 337/86 |
| 3,577,111 | 5/1971 | Nardulli | 337/89 |
| 3,600,528 | 8/1971 | Leposavic | 200/5 A |

FOREIGN PATENTS OR APPLICATIONS

| | | | |
|---|---|---|---|
| 1,216,717 | 4/1960 | France | 200/243 |

*Primary Examiner*—Harold Broome
*Attorney, Agent, or Firm*—John A. Haug; James P. McAndrews; Russell E. Baumann

[57] ABSTRACT

A low cost multiphase motor protector which employs only one movable contact attached to the center of a bimetallic snap-acting disc. After the disc is calibrated and upon the application or dissipation of heat, the one movable contact either connects or disconnects with a plurality of stationary contact terminals simultaneously.

8 Claims, 7 Drawing Figures

MOTOR PROTECTOR APPARATUS

BACKGROUND AND SUMMARY OF INVENTION

This invention relates generally to a new low cost design for a multiphase thermally responsive circuit breaker and more particularly to a three-phase motor protector.

In a multiphase motor protector, it has been standard practice to use some array of movable contacts matching up with an equal number of stationary contacts. Then, upon some means of actuation force, pairs of contacts will move into or out of engagement with one another.

Among the several objects of this invention is to provide a protective device that is small and compact, yet long lasting and reliable to provide easier production techniques for such a device and to provide less expensive manufacturing costs and material savings in producing such a device. Other objects and features will be in part apparent and in part pointed out hereinafter.

The device of this invention employs a sole movable contact in a multiphase protector, such as a three-phase motor protector, instead of the normal use of a separate movable contact for each phase. The one movable contact is centrally mounted on a snap-acting bimetallic disc and positioned relative to the three stationary contact terminals which are centered in a cluster so that the one movable contact can make contact with all three terminal contacts at once. Then upon thermal energy being applied or dissipated to or from the bimetallic disc, the movable contact will move into or out of engagement with all three terminal contacts.

The device made in accordance with the invention has the advantage of having fewer parts than conventional protectors and therefore is easy and inexpensive to manufacture. Also the use of only one contact saves material which is very important for both economic and conservation reasons.

The invention accordingly comprises the constructions hereinafter described, the scope of the invention being indicated in the following claims.

In the accompanying drawings in which several of the various possible embodiments of the invention are illustrated, FIG. 1 is a cross-sectional elevational view of a device made in accordance with this invention with the movable contact in the closed position;

Figure 5:
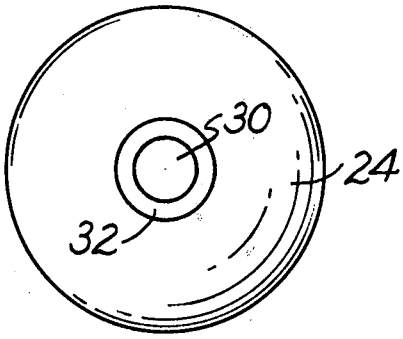
FIG. 5 is a top plan view of the bimetallic disc with the movable contact showing a second embodiment of the invention.
Figure 6A:
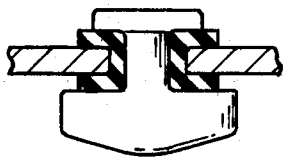
Figure 6B:
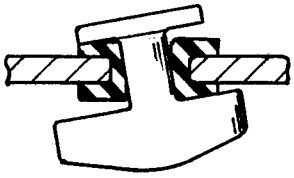

FIG. 6*a* is an enlarged cross-sectional view of the FIG. 5 movable contact mounted in a flexible bushing in a straight position; and FIG. 6*b* is an enlarged cross-sectional view of the FIG. 5 movable contact mounted in the flexible bushing in a tilted position.

Referring now to the drawings, a preferred embodiment of this invention takes the form of a thermally responsive three-phase motor protector generally indicated by reference numeral 10 which includes a generally cup-shaped casing 12 molded from a suitable electrical insulating material such as a phenolic resin. The casing 12 has three hollow concentric wells 11, 13 and 15 of different diameters which decrease in size from the top to the bottom of the casing 12 as viewed in FIG. 1. The side wall 14 of the casing 12 correspondingly increases in thickness as the central wells 11, 13 and 15 reduce in diameter leaving annular ledges 16, 18 and bottom surface 20 as illustrated in FIGS. 1 and 2.

A casing top 22 also made from a suitable electrical insulating material such as a phenolic resin has a flat top surface and a dome-shaped bottom surface to allow room for a disc 24, to be discussed further infra, to snap through center when moving to the contacts open position. Casing top 22 freely fits into the largest hollow well 11 so that the outside edge of the bottom surface of casing top 22 and the first ledge 16 in the casing side wall 14 loosely hold the edge portion of a bimetallic element or disc 24 in position. During assembly of the device, casing top 22 is dropped in place using only the force of gravity to locate it in its desired location so the top does not unduly constrain the movement of the disc 24. Once the casing top 22 is in this position, it is epoxy sealed to the casing 12. Then the edge portion of the disc 24 is properly constrained so the device can be properly calibrated.

Figure 1:
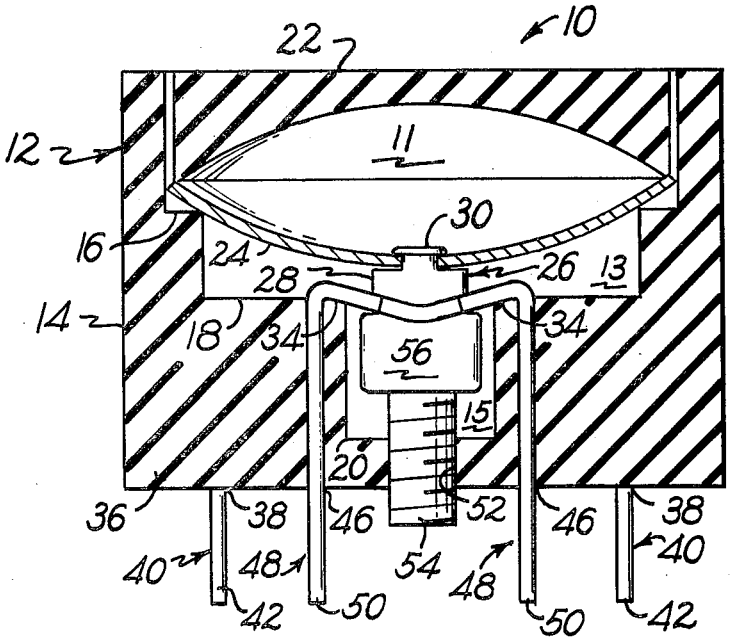
Figure 2:
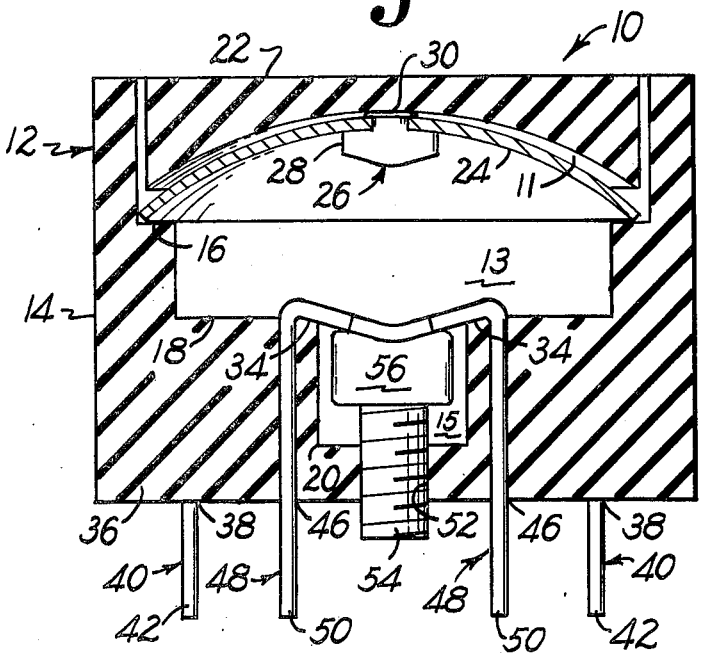
FIG. 2 is a cross-sectional view similar to FIG. 1 of a device made in accordance with this invention with the movable contact in the open position.

The disc 24 is preferably a dish-shaped bimetallic element having one layer of a low thermal coefficient of expansion and the other layer of somewhat higher thermal coefficient of expansion, so that upon heating and cooling of the disc it snaps between the positions shown in FIGS. 1 and 2 and moves the sole movable contact 26 along a line toward and away from the stationary contact terminals 48.

A movable contact 26 is mounted on the thermally responsive disc 24 and may comprise a rivet which extends through a centrally located aperture on the disc 24 as shown in FIGS. 1 and 2. The rivet is typically made out of a good electrical contact material as fine silver and has a head or contact portion 28 which is formed with a taper on its outer surface to better allow the contacting head portion upon actuation to make contact with the three stationary contacts 34. The rivet also has a cap portion 30 on the opposite end of the rivet from the head portion and a shank portion.

Figure 3:
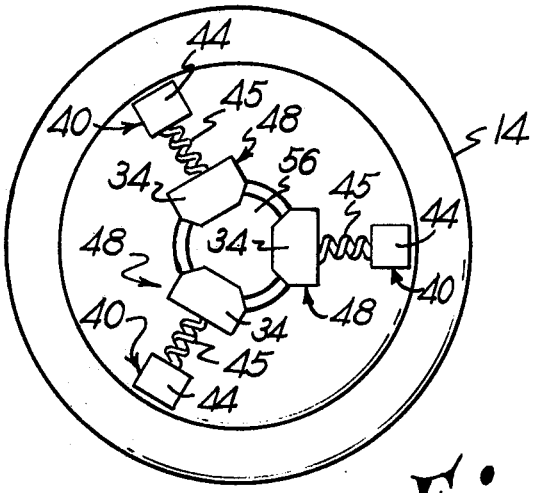
FIG. 3 is a top plan view of the FIG. 1 motor protector apparatus with the top section and disc removed.
Figure 4:
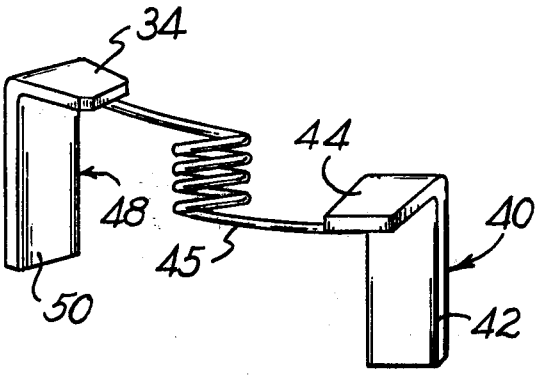
FIG. 4 is an enlarged perspective view of the terminal heater and contact means of the motor protector apparatus in FIG. 1.

If it is desirable to provide heaters for the several phases, the bottom wall 36 of the casing 12 preferably has three outer slots 38 conveniently spaced 120° apart and are each to receive a heater terminal 40. The heater terminal 40 has a straight leg portion 42 which, as seen in FIG. 1 and 2, extends out of the casing 12 and a head portion 44 as shown in FIGS. 3 and 4 to which a conventional heater wire 45 is attached as by welding. The casing bottom 36 also has three inner slots 46 which are preferably spaced 120° apart and are adapted to receive the stationary contact terminals 48. Each stationary contact terminal 48 has a straight leg portion 50 which extends from well 13 downward out the bottom of the casing 12 as shown in FIGS. 1 and 2 and a stationary contact 34 which is bent out of the plane of leg portion 50 and preferably more than 90° in relation to the plane to form an acute angle there between. The opposite end of the heater wire 45 from that end which is attached to the heater terminal 40 is attached in a like manner to the stationary contact terminal 34 as shown in FIGS. 3, 4 so that the device can quickly and accurately respond to an increased load and therefore an increase in heat buildup. It will be understood that an appropriate cavity is formed in bottom wall 36 to receive wire 45 so that wire 45 is positioned in heat transfer relation with disc 24.

Centrally located in the bottom wall of the casing 12 is a threaded hole 52 which receives a calibration screw 54 for the device. The calibration screw 54 abuts against an insulator element 56 which may be in the form of a disc which in turn abuts against the three stationary contacts 34. The purpose of the insulator element 56 is to electrically insulate the screw member 54 from the three stationary contacts 34. Turning of the calibration screw 54 inwardly causes the insulator element 56 to push against the stationary contacts 34 bending them as desired to change the force exerted by the disc 24 against contacts 34 through movable contact 26 when in the closed position to thereby calibrate the opening temperature of the device.

The device is calibrated for trip at a prescribed temperature. As current passes through the heater wires 45, heat is generated through $I^2R$ heating. It will be understood that the device is also sensitive to variations in ambient temperature which must be taken into consideration. Excessive heat will cause the temperature of the disc to increase until it reaches its trip temperature at which time it will snap to an open position as shown in FIG. 2. The device remains in the open position until sufficient cooling takes place and then the disc 24 snaps back to the closed position.

FIGS. 5, 6*a*, and 6*b* shows a modification of the FIGS. 1 and 2 structure in which a special means is provided for mounting movable contact 26. As shown in the figures contact 26 is mounted in a loose fitting flexible bushing 32 which is press fitted into the aperature in the thermally responsive disc 24. The loose fitting flexible bushing as best shown in FIGS. 6*a* and 6*b* allows the rivet and more particularly the contact portion to tilt or rotate to position 6*b* from the standard alignment 6*a* to better assure the reliability of the electrical connection with all three stationary contacts 34 in the event that there is misalignment of any of the stationary contacts. Thus, should there be a misalignment of any of the stationary contacts, reliable electrical connection among all the stationary contacts with the movable contact will be ensured by means of this tilting capability.

Although several particular embodiments of this invention have been described by way of illustration, this invention includes all modifications and equivalents thereof falling within the scope of the apended claims.

I claim:

1. An apparatus for connecting and disconnecting a circuit comprising a generally open ended cupshaped casing formed of electrically insulative material, the casing having a base and side walls extending therefrom, more than two stationary contacts centrally mounted in the casing, a sole movable contact mounted in the casing, and a snap-action bimetallic disc secured in the casing with the sole movable contact affixed to the disc, the disc movable between first and second configurations upon thermal energy being applied and dissipated to and from the disc to move the movable contact into and out of engagement with the more than two stationary contacts.

2. An apparatus made according to claim 1 further including alignment means for the sole contact to ensure reliability of electrical connection with all stationary contacts.

3. An apparatus made according to claim 2 further including calibration means to preselect the temperature at which the movable contact will break engagement with the stationary contacts.

4. An apparatus for connecting and disconnecting a circuit comprising a generally open ended cup-shaped casing formed of electrically insulative material, the casing having a base and side walls extending therefrom, a plurality of stationary contacts mounted in the casing, a sole movable contact mounted in the casing, a snap action bimetallic disc with the sole movable contact affixed to the disc, the disc movable between first and second configurations upon thermal energy being applied and dissipated to and from the disc to move the movable contact into and out of engagement with the plurality of stationary contacts, the disc having an outer peripheral edge, a ledge formed in the side walls of the casing, a cover which fits on the cup-shaped casing, the edge being contained between the ledge and cover, and a threaded hole in the base of the casing, a screw received in the hole, an insulator element disposed intermediate the stationary contacts and the screw, the screw adapted to abut against the insulator element, the insulator element in turn abuts against the stationary contacts, whereby movement of the screw inwardly will move the stationary contacts and calibrate the apparatus.

5. An apparatus made according to claim 4 further including heater elements used to provide heat generation.

6. An apparatus made according to claim 5 wherein there are three stationary contacts.

7. An apparatus for connecting and disconnecting a circuit comprising a generally open ended cup-shaped casing formed of electrically insulative material, the casing having a base and side walls extending therefrom, more than two stationary contacts centrally mounted in the casing, a sole movable contact mounted in the casing which moves along a line toward and away from the stationary contacts, said stationary contacts each lying in a plane which forms an acute angle with said line, and means to move the movable contact into and out of engagement with the more than two stationary contacts.

8. An apparatus for connecting and disconnecting a circuit comprising a generally open ended cup-shaped casing formed of electrically insulative material, the casing having a base and side walls extending therefrom, a plurality of stationary contacts mounted in the casing, a sole movable rivet contact mounted in the casing, a snap-action bimetallic disc with said movable rivet contact affixed to the disc, the disc movable between first and second configurations upon thermal energy being applied and dissipated to and from the disc, the disc having an outer peripheral edge, a ledge formed in the side walls of the casing, a cover which fits on the cup-shaped casing, the edge being contained between the ledge and the cover, and a flexible bushing disposed in an aperature in the disc, said rivet extending through the flexible bushing allowing said rivet to tilt for reliability of electrical connection with all stationary contacts.

* * * * *